US009062688B2

(12) United States Patent
Joshi et al.

(10) Patent No.: US 9,062,688 B2
(45) Date of Patent: Jun. 23, 2015

(54) DIAPHRAGM PUMP

(75) Inventors: Shailesh N. Joshi, Ann Arbor, MI (US); Jaewook Lee, Kyungki-do (KR); Ercan Mehmet Dede, Ann Arbor, MI (US)

(73) Assignee: TOYOTA MOTOR ENGINEERING & MANUFACTURING NORTH AMERICA, INC., Erlanger, KY (US)

( * ) Notice: Subject to any disclaimer, the term of this patent is extended or adjusted under 35 U.S.C. 154(b) by 288 days.

(21) Appl. No.: 13/528,358

(22) Filed: Jun. 20, 2012

(65) Prior Publication Data

US 2013/0343913 A1 Dec. 26, 2013

(51) Int. Cl.

| | |
|---|---|
| ***F04D 33/00*** | (2006.01) |
| ***F04B 19/00*** | (2006.01) |
| ***F04B 43/04*** | (2006.01) |

(52) U.S. Cl.

CPC ..... *F04D 33/00* (2013.01); *F04B 19/006* (2013.01); *F04B 43/043* (2013.01)

(58) Field of Classification Search

CPC ..... F04B 43/0045; F04B 43/0054; F04B 43/023; F04B 43/043; F04B 43/14; F04B 45/045; F04B 45/047

USPC ..... 417/50, 478, 413.1; 92/103 R

See application file for complete search history.

(56) References Cited

U.S. PATENT DOCUMENTS

| | | | | |
|---|---|---|---|---|
| 5,499,909 | A | 3/1996 | Yamada et al. | |
| 5,542,821 | A | 8/1996 | Dugan | |
| 6,408,884 | B1 | 6/2002 | Kamholz et al. | |
| 2002/0098097 | A1* | 7/2002 | Singh | 417/413.1 |
| 2004/0037708 | A1* | 2/2004 | Murasato et al. | 417/99 |
| 2005/0069424 | A1 | 3/2005 | Lu et al. | |
| 2006/0045766 | A1* | 3/2006 | Harttig et al. | 417/412 |
| 2008/0240942 | A1* | 10/2008 | Heinrich et al. | 417/322 |
| 2010/0111726 | A1 | 5/2010 | Fu et al. | |

FOREIGN PATENT DOCUMENTS

| | | | |
|---|---|---|---|
| DE | 19725685 | A1 | 12/1998 |
| GB | 2133225 | A | 7/1984 |
| JP | 59218377 | A | 12/1984 |
| JP | 5087056 | A | 4/1993 |
| JP | 2007-231747 | A | 9/2007 |
| RU | 2037653 | C1 | 6/1995 |

* cited by examiner

*Primary Examiner* — Charles Freay
*Assistant Examiner* — Kenneth J Hansen
(74) *Attorney, Agent, or Firm* — Oblon, McClelland, Maier & Neustadt, L.L.P.

(57) ABSTRACT

An apparatus that includes a chamber. The chamber includes an inlet via which process fluid enters the chamber and an outlet via which the process fluid exits the chamber. A diaphragm is fixed in position in the chamber at a periphery of the diaphragm. The diaphragm includes a magnetic fluid therein.

19 Claims, 6 Drawing Sheets

DIAPHRAGM PUMP

BACKGROUND

1. Field

The embodiments discussed herein relate to a pump that includes a chamber having an inlet and outlet that open and close to allow a non-magnetic process fluid to enter and exit. More specifically, the apparatus described herein relates to a pump that is actuated by a magnetic field. The pump may be a micro-pump.

2. Description of the Related Art

Pumps that use a diaphragm or membrane may be used as positive displacement pumps. Generally, in a positive displacement pump, the diaphragm is sealed with one side facing the fluid to be pumped, and the other side of the diaphragm facing an open environment, such as air. When the diaphragm is flexed, the volume of the pump chamber increases or decreases depending on the direction of the flexure. The flexing of the diaphragm is accomplished via electro-mechanical action.

SUMMARY

According to an embodiment of the present invention, the apparatus includes a chamber through which a process fluid is pumped. The process fluid enters the chamber via an inlet and exits via an outlet. A diaphragm including a magnetic fluid therein is fixed in place in the chamber at an outermost periphery of the diaphragm.

According to another embodiment of the present invention, the apparatus includes a chamber including a plurality of sub-chambers, through which the process fluid is pumped. The apparatus further includes at least one inlet via which process fluid enters one or more of the plurality of the sub-chamber and at least one outlet via which the process fluid exits one or more of the plurality of the sub-chambers. A flexible diaphragm membrane is secured to the chamber between adjacent sub-chambers. The membrane includes an internal closed pocket containing a magnetic fluid therein.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings. However, the accompanying drawings and their exemplary depictions do not in any way limit the scope of the inventions embraced by this specification. The scope of the inventions embraced by the specification and drawings are defined by the words of the accompanying claims.

DETAILED DESCRIPTION

In the following, the present advancement will be discussed by describing a preferred embodiment with reference to the accompanying drawings. However, those skilled in the art will realize other applications and modifications within the scope of the disclosure as defined in the enclosed claims.

Figure 1:
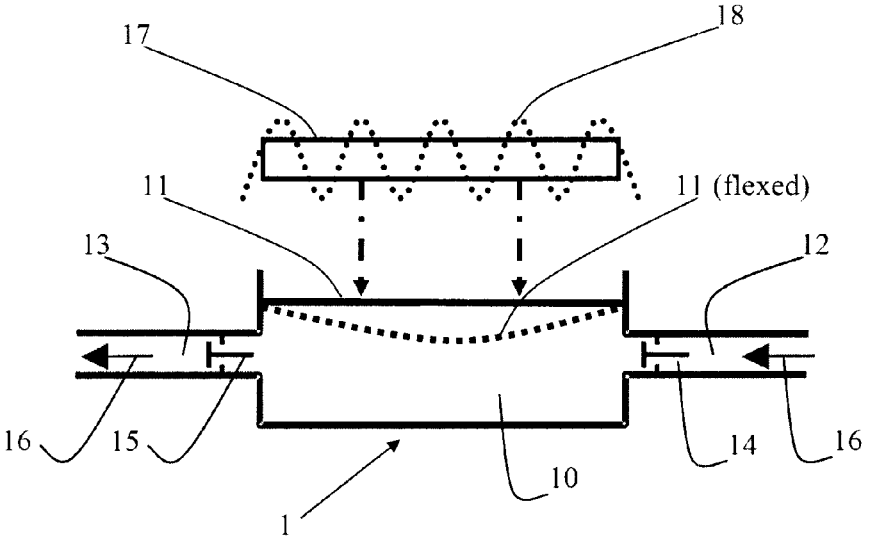
FIG. 1 is a schematic, cross-sectional drawing of the apparatus according to an exemplary embodiment of the present disclosure.

FIG. 1 is a schematic, cross-sectional drawing of a single-chamber magnetic fluid pump 1. The pump 1 includes a chamber 10 formed of side and bottom walls enclosed by a diaphragm 11 (also known as a membrane) fixed in place in the chamber 10. The diaphragm 11 may be secured to the chamber 10 by compressing a periphery of the diaphragm 11 between wall portions of the chamber 10, or by other fastening means that allows the diaphragm 11 to flex with minimal risk of breaking or disconnecting from the chamber 10. For example, the diaphragm 11 may be adhered to the chamber 10 with a suitable adhesive or by a mechanical fastener. It is important that whichever means of fastening is used creates a seal between the diaphragm 11 and the chamber so that the pressure inside the chamber 10 can be manipulated effectively to pump the process fluid. Note that the solid line of the diaphragm 11 in FIG. 1 (and similarly in FIGS. 3 and 4) is indicative of the diaphragm 11 at rest, and the dotted-line of the diaphragm 11 is indicative of the diaphragm 11 when flexed. In FIG. 1, the outermost periphery of the diaphragm 11 is fixed in place in the chamber 10, however, it is understood that an inner portion of the diaphragm 11 could be fixed to the chamber 10 instead, so long as a sealed space is created between the fixed portion of the diaphragm 11 and the inside of the chamber 10.

The process fluid enters and exits the chamber 10 via a process fluid inlet 12 and a process fluid outlet 13, respectively. The inlet 12 and the outlet 13 adjoin a wall of the chamber. While FIG. 1 depicts the inlet 12 and the outlet 13 on opposing positions of the side wall/s in the chamber 10, this is only for the sake of convenience in order to clearly depict the inlet 12 and outlet 13 as distinct. In fact, inlet 12 and outlet 13 may be located proximate to or distant from each other, and may be disposed on any wall surface at any height on the wall surface. For example, it may be advantageous to position at least outlet 13 at or near the bottom of the chamber 10 to reduce any undesired fluid buildup in the bottom and to ensure adequate circulation of the process fluid.

Figure 2:
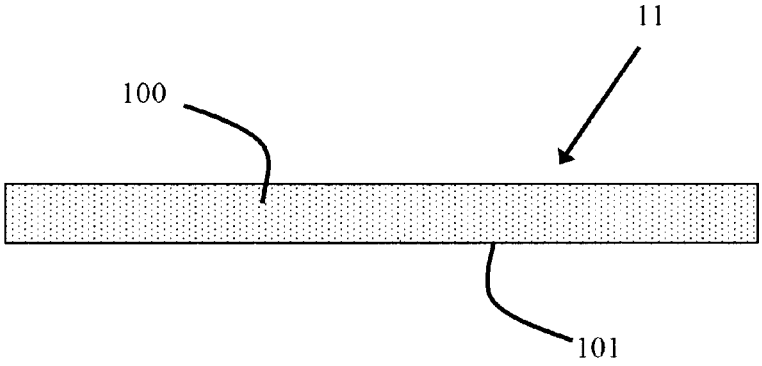
FIG. 2 is a schematic, cross-sectional drawing of the diaphragm including a magnetic fluid according to an exemplary embodiment of the present disclosure.

The flow direction 16 of the process fluid through the chamber 10 is shown as arrows in inlet 12 and outlet 13, respectively. The process fluid moves through the chamber 10 due to flexure of the diaphragm 11, which contains a magnetic fluid 100 therein, as shown in FIG. 2. A magnetic field source 17 creates a magnetic field 18, which can be varied, and which induces the diaphragm 11 to flex due to the magnetic pull or push on the magnetic fluid 100 in the diaphragm 11. The magnetic field source 17 may be a permanent magnet or an electromagnet, for example.

Furthermore, in the embodiment shown in FIG. 1, process fluid flow is regulated through the inlet 12 via a unidirectional inlet valve 14, and through the outlet 13 via a unidirectional outlet valve 15. The inlet valve 14 allows process fluid to flow in one direction. Specifically, process fluid is allowed to enter the chamber 10 via inlet 12 and inlet valve 14 when the diaphragm 11 flexes in a manner to increase the volume of the chamber 10 (in the case of FIG. 1, the diaphragm flexes upward to increase the volume of the chamber 10), and the inlet valve 14 prevents process fluid from exiting via inlet 12 when the diaphragm 11 flexes in a manner to decrease the volume of the chamber 10 (in the case of FIG. 1, the diaphragm flexes downward to decrease the volume of the chamber 10). Similarly, the outlet valve 15 only allows flow in one direction. Outlet valve 18, however, allows process fluid to exit the chamber 10 via outlet 13 when the diaphragm 11 flexes so as to decrease the volume of the chamber 10 and prevents process fluid from entering via outlet 13 when the diaphragm 11 flexes so as to increase the volume of the chamber 10.

The magnetic fluid 100 in the diaphragm 11 may be a magnetic ferro-fluid, or any other fluid having magnetic properties which can be manipulated by the magnetic field 18. In contrast, it is noted that the process fluid should not have magnetic properties that would cause the process fluid to interact with the magnetic field 18.

The diaphragm 11 may be made of a flexible polymer material, or any other durable material that can endure repeated flexure while maintaining the integrity of the diaphragm 11. The material of the diaphragm 11 must also be compatible with both the process fluid passing through the chamber 10 and the magnetic fluid 100. That is, the quality and effectiveness of the material of the diaphragm 11 should not easily deteriorate or be weakened due to contact with either or both of the process fluid and the magnetic fluid 100.

Figure 7:
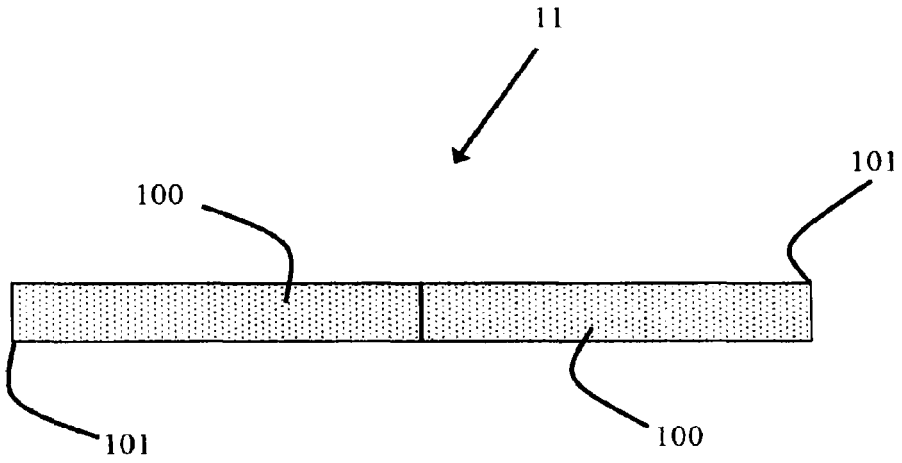
FIG. 7 is a schematic, cross-sectional drawing of the diaphragm including a magnetic fluid according to an exemplary embodiment of the present disclosure.

Additionally, the diaphragm 11 may have a single enclosed pocket 101 in which the magnetic fluid 100 is disposed. It is also contemplated that that the diaphragm 11 may have a plurality of smaller pockets therein, as shown for example in FIG. 7. The pocket 101 (or pockets) may be filled completely with the magnetic fluid 100, or only partially filled. The amount of magnetic fluid 100 in the pocket 101 may depend on various factors such as flexibility, component material type, strength, and responsiveness to the applied magnetic field 18, for example.

It is contemplated that the side and bottom walls of the chamber 10 may be made of a non-magnetic material. For example, a non-magnetic stainless steel may be used to form the side and bottom walls of the chamber 10. Alternatively, the chamber 10 may be made of a polymeric material that is more rigid than the material of the diaphragm 11.

Figure 3:
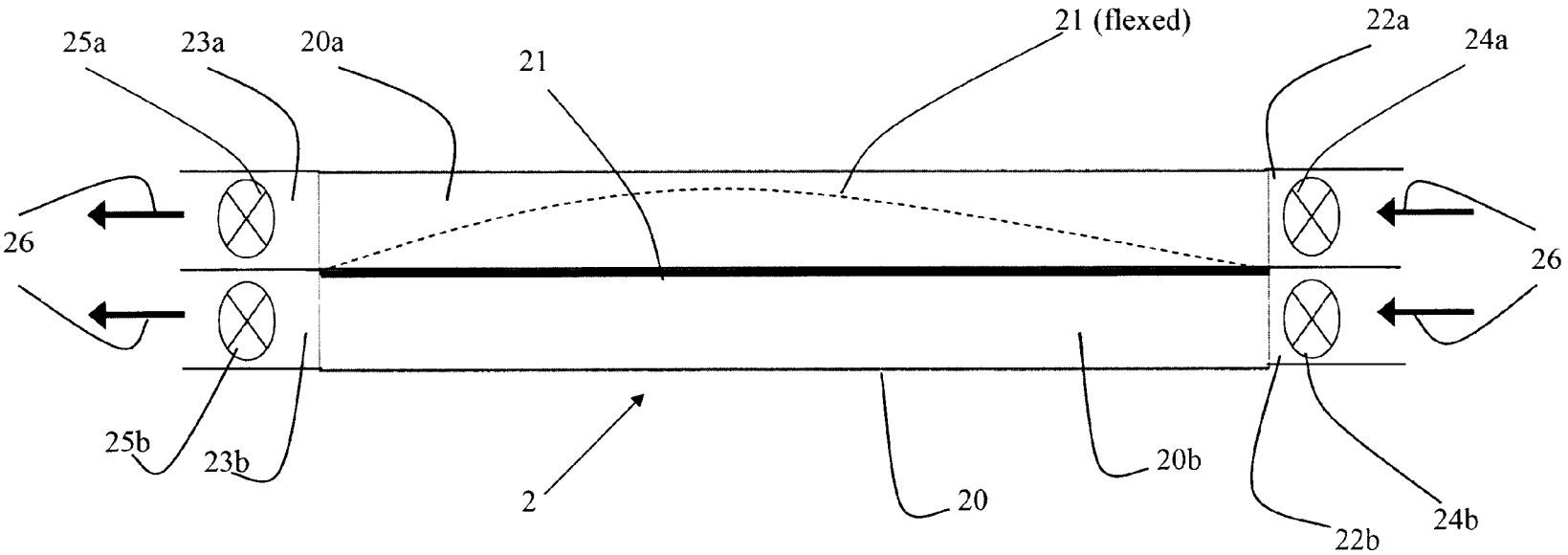
FIG. 3 is a schematic, cross-sectional view drawing of a dual-chamber apparatus according to an exemplary embodiment of the present disclosure.

The magnetic fluid pump 2 shown in FIG. 3 includes some features similar to those found in the embodiment shown in FIG. 1, however, the pump 2 is a dual-chamber pump. Specifically, pump 2 includes a chamber 20, which is divided into a first sub-chamber 20*a* and a second sub-chamber 20*b*. The diaphragm 21 is disposed between the first and second sub-chambers 20*a* and 20*b*. Furthermore, each of the first and second sub-chambers 20*a* and 20*b* includes a distinct process fluid inlet 22*a* and 22*b*, respectively, and a distinct process fluid outlet 23*a* and 23*b*, respectively. Similarly, each of the first and second sub-chambers 20*a* and 20*b* also includes distinct unidirectional inlet valves 24*a* and 24*b*, respectively, and distinct unidirectional outlet valves 25*a* and 25*b*, respectively, via which the process fluid flows through each sub-chamber. The fluid flow direction 26 is indicated by the arrows in the respective inlets 22*a* and 22*b* and outlets 23*a* and 23*b*.

As with the movement of the process fluid in pump 1 of FIG. 1, process fluid flows through pump 2 by means of inducing diaphragm 21 to flex via a magnetic field source (not shown in FIG. 3) that manipulates the magnetic fluid (not shown in FIG. 3) in diaphragm 21.

Although the chamber 20 has a fixed volume overall, the volume of first and second sub-chambers 20*a* and 20*b* varies depending on the direction in which diaphragm 21 is flexing. That is, when diaphragm 21 flexes upward into first sub-chamber 20*a* (as depicted in FIG. 3), the volume of first sub-chamber 20*a* decreases, thereby increasing the internal pressure and forcing process fluid to exit first sub-chamber 20*a* via the outlet valve 25*a*. Simultaneously, the upward flexure of diaphragm 21 increases the volume of second sub-chamber 20*b*, thereby creating a vacuum and drawing in process fluid via the inlet valve 24*b*. Then, when diaphragm 21 flexes downward into second sub-chamber 20*b*, the volume of second sub-chamber 20*b* decreases, thereby increasing the internal pressure and forcing the process fluid that was just drawn therein to exit second sub-chamber 20*b* via the outlet valve 25*b*. Further, the downward flexure of diaphragm 21 increases the volume of first sub-chamber 20*a*, thereby creating a vacuum and drawing in process fluid via the inlet valve 24*a*. Accordingly, process fluid is cycled into one sub-chamber and out of the adjacent sub-chamber with each flex of diaphragm 21.

Figure 4:
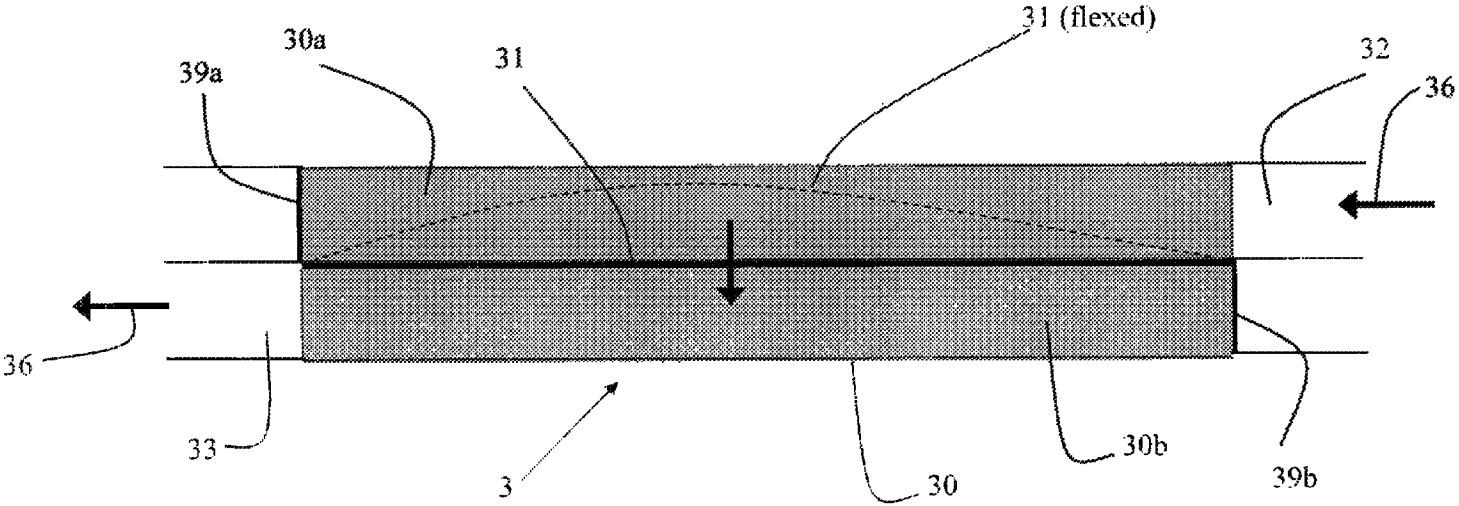
FIG. 4 is a schematic, cross-sectional view drawing of the apparatus having a plurality of sub-chambers according to an exemplary embodiment of the present disclosure.

In another embodiment show in FIG. 4, a magnetic fluid pump 3 includes a chamber 30 divided into a first sub-chamber 30a and a second sub-chamber 30*b* by diaphragm 31. Process fluid enters first sub-chamber 30*a* via process fluid inlet 32 and exits second sub-chamber 30*b* via process fluid outlet 33. The fluid flow direction 36 is indicated by the arrows in inlet 32 and outlet 33 and through the diaphragm 31. Although *Fig*. 4 does not depict unidirectional valves in pump 3 like those in pumps 1 and 2, it is understood that valves may be incorporated therein to assist in the process fluid flow.

Unlike the distinct first and second sub-chambers 20*a* and 20*b* of the chamber 20 in pump 2, process fluid is able to pass between first and second sub-chambers 30*a* and 30*b* of the chamber 30 in pump 3. Process fluid is allowed to pass through diaphragm 31 because, in addition to including a magnetic fluid in diaphragm 31, diaphragm 31 includes at least a portion thereof that is permeable in only one direction, for example, downward or in the direction of gravity as shown in FIG. 4. Thus, as depicted in *Fig*. 4, the first sub-chamber 30*a* does not include a distinct outlet and the second sub-chamber 30*b* does not include a distinct inlet. Instead, first sub-chamber 30*a* includes the inlet 32 and the rest of the walls in the first sub-chamber 30*a* are fixed (shown as fixed wall 39*a*). Similarly, second sub-chamber 30*b* includes the outlet 33 and the rest of the walls in the second sub-chamber 30*b* are fixed (shown as fixed wall 39*b*). It is contemplated, however, that each of the first and second sub-chambers 30*a* and 30*b* may have an access aperture (not shown) through the fixed walls 39*a* and 39*b*, respectively, which may be used as an outlet for cleaning, repair, or other purposes.

In the embodiment of pump 3 shown in FIG. 4, the process fluid flowing into the first sub-chamber 30*a* may be gravity fed with static pressure. Thus, in combination with the magnetic fluid in diaphragm 31, upon causing the diaphragm 31 to flex by way of a magnetic field source (not shown in *Fig*. 4, see FIG. 1), process fluid is drawn into the first sub-chamber 30*a* via the inlet 32, passes through the permeable portion of diaphragm 31, and exits the second sub-chamber 30*b* via the outlet 33. Therefore, the fluid flow path begins in the first sub-chamber 30*a* and ends by exiting the second sub-chamber 30*b*.

Figure 5:
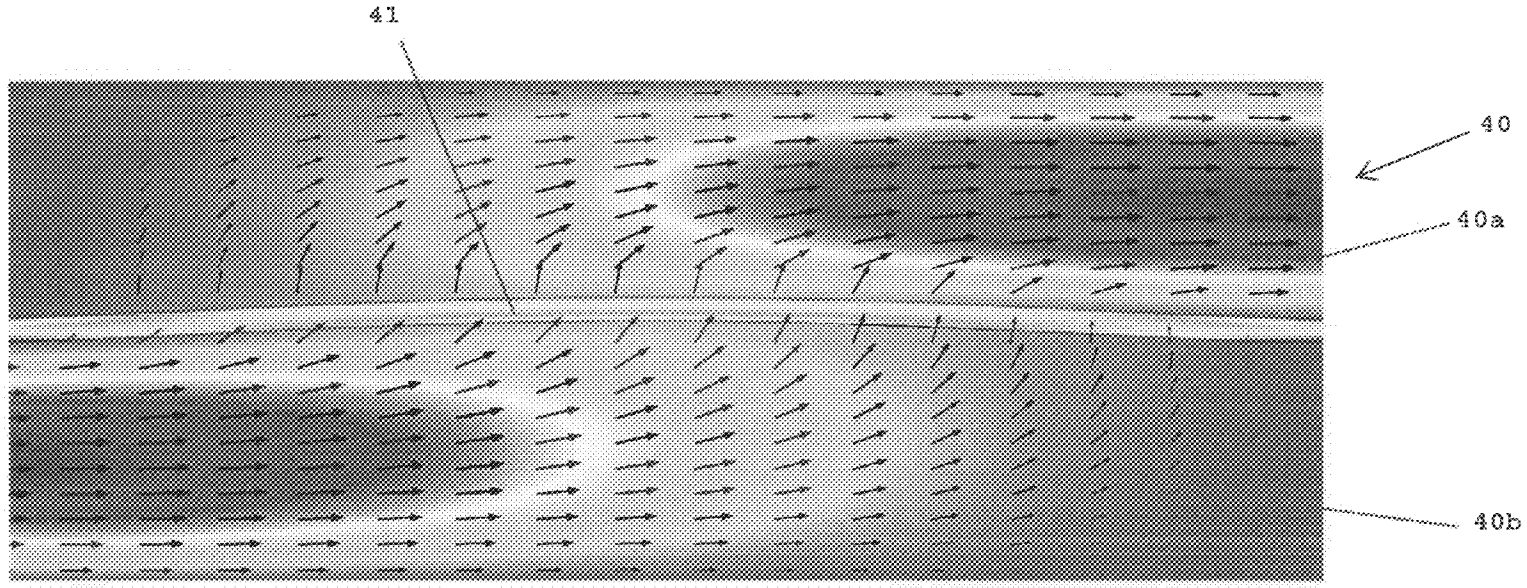
FIG. 5 is a schematic, cross-sectional side view of pressure simulation in a dual-chamber pump according to an exemplary embodiment of the present disclosure.

FIG. 5 depicts a cross-sectional view of a simulation of a pressure gradient in a pump chamber 40. The chamber 40 is divided into a distinct first sub-chamber 40*a* and a distinct second sub-chamber 40*b* by a diaphragm 41. The diaphragm 41 is like the diaphragms 11 and 21 of the embodiments shown in FIGS. 1 and 3, respectively, in that diaphragm 41 contains magnetic fluid therein and is not permeable. The direction of the fluid velocity vectors with pressure contours, during flexure of the diaphragm 41, is also shown as arrows in the first and second sub-chambers 40*a* and 40*b*. The change in pressure from the second sub-chamber 40*b* to the first sub-chamber 40*a* drives the flow of fluid from one sub-chamber into the other.

Figure 6:
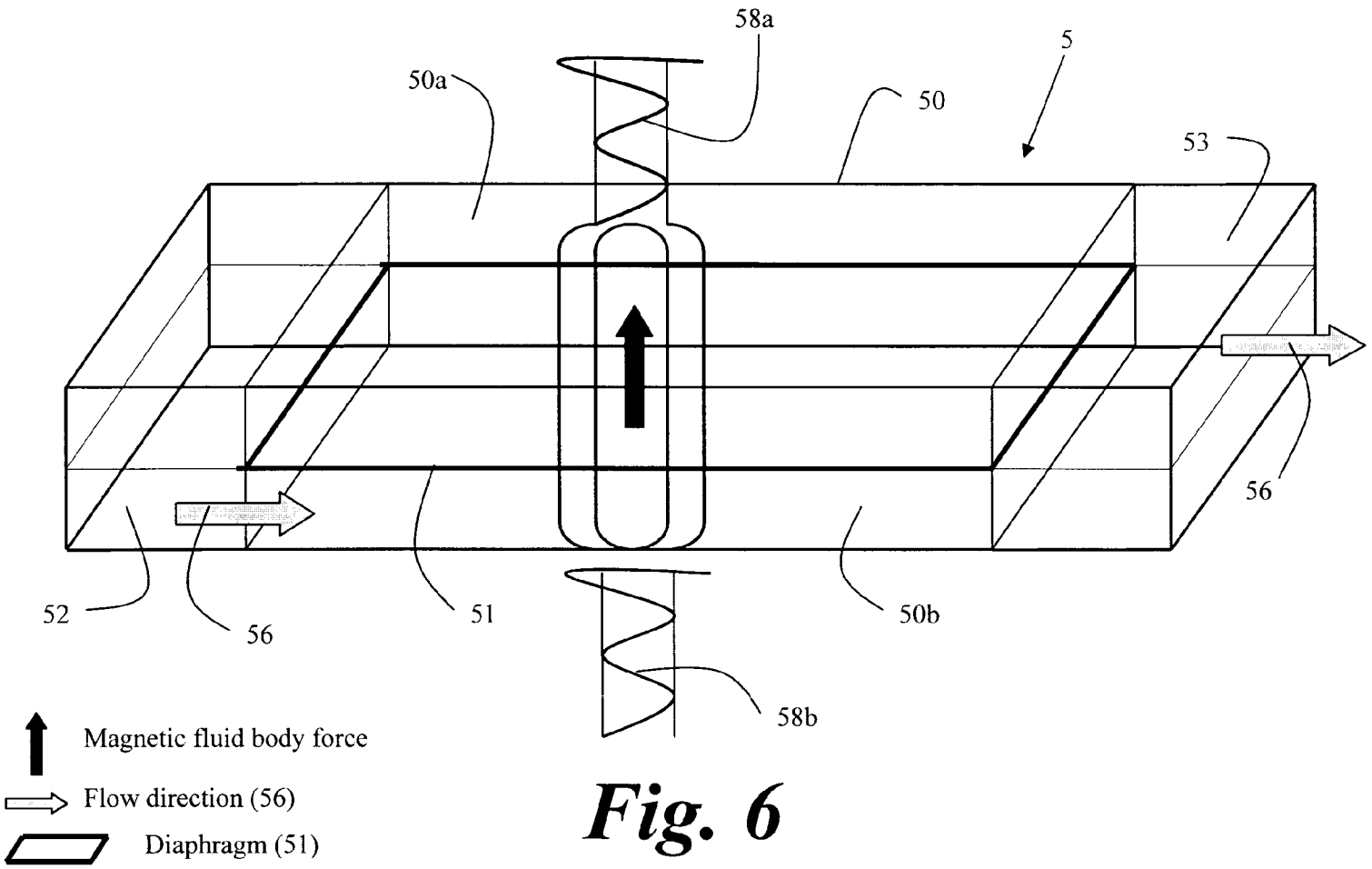
FIG. 6 is a schematic perspective view drawing of another dual chamber apparatus according to an exemplary embodiment of the present disclosure.

FIG. 6 depicts a schematic perspective view of a dual-chamber pump 5 like the pump 2 in FIG. 3. Pump 5 includes a chamber 50 divided by diaphragm 51 into a first sub-chamber 50*a* and a second sub-chamber 50*b*. Magnetic flux lines are shown such that flux line 58*a* indicates that the magnetic field source (not shown) is on and flux line 58*b* indicates that the magnetic field source is off As such, the diaphragm 51 is manipulated upward so that process fluid enters second sub-chamber 50*b* via inlet 52, and the process fluid previously drawn into the first sub-chamber 50*a* is expelled from the first sub-chamber 50*a* via the outlet 53. Accordingly, the process fluid flow direction 56 is shown by the arrows in inlet 52 and outlet 53. It is noted that the distinct inlet of the first sub-chamber 50*a* and the distinct outlet of the second sub-chamber 50*b* are not labeled in FIG. 6.

Obviously, numerous modifications and variations of the present invention are possible in light of the above teachings. It is therefore to be understood that within the scope of the appended claims, the invention may be practiced otherwise than as specifically described herein.

The invention claimed is:

1. An apparatus, comprising:

a chamber;

an inlet via which process fluid enters the chamber;

an outlet via which the process fluid exits the chamber; and a diaphragm including one or more closed pockets, each pocket having a magnetic fluid therein, a periphery of the diaphragm being fixed in position in the chamber, and the diaphragm includes a permeable section that is permeable to the process fluid in only a single direction.

2. The apparatus according to claim 1, further comprising a magnetic field source that creates a magnetic field, in response to which the diaphragm flexes to pump the process fluid through the chamber.

3. The apparatus according to claim 1, wherein the diaphragm flexes in response to a magnetic field, and wherein an intensity of the magnetic field determines a magnitude of flexure of the diaphragm.

4. The apparatus according to claim 1, wherein the diaphragm encloses a portion of the chamber and flexes in opposite directions, depending on a magnetic field created near the diaphragm, so as to increase or decrease a volume of the portion of the chamber, thereby pumping the process fluid through the portion of the chamber, and wherein when the volume of the portion of the chamber increases, the process fluid is drawn into the chamber, and when the volume of the portion of the chamber decreases, the process fluid is expelled from the chamber.

5. The apparatus according to claim 1, wherein the inlet includes a unidirectional valve.

6. The apparatus according to claim 1, wherein the outlet includes a unidirectional valve.

7. The apparatus according to claim 1, wherein the inlet and the outlet are disposed on one or more wall portions of the chamber, the one or more wall portions being enclosed by the diaphragm such that the inlet and the outlet are on a same side of the diaphragm.

8. An apparatus, comprising:

a chamber divided into first and second sub-chambers;

an inlet via which process fluid enters the chamber;

an outlet via which the process fluid exits the chamber; and a diaphragm including one or more closed pockets, each pockets having a magnetic fluid therein, a periphery of the diaphragm being fixed in position to interior walls of the chamber at a perimeter of the diaphragm between the first and second sub-chambers, and the diaphragm includes a permeable section that is permeable to the process fluid in only a single direction, wherein, the first sub-chamber is disposed on a first side of the diaphragm and the second sub-chamber is disposed on a second side of the diaphragm opposing the first side.

9. The apparatus according to claim 8, wherein the inlet is a first inlet and the process fluid enters the first sub-chamber via the first inlet, wherein the outlet is a first outlet and the process fluid exits the first sub-chamber via the first outlet, wherein the apparatus further comprises:

a second inlet via which the process fluid enters the second sub-chamber; and a second outlet via which the process fluid exits the second sub-chamber; and wherein the first inlet and the first outlet accommodate pumping the process fluid through the first sub-chamber, and the second inlet and the second outlet accommodate pumping the process fluid through the second sub-chamber.

10. The apparatus according to claim 9, wherein the diaphragm flexes according to a magnetic field created near the diaphragm thereby affecting a volume capacity of the first and second sub-chambers simultaneously, wherein when the magnetic field is such that the diaphragm flexes away from the first sub-chamber and into the second sub-chamber, the process fluid is drawn into the first sub-chamber via the first inlet due to an increase in the volume capacity of the first sub-chamber and the process fluid is expelled from the second sub-chamber via the second outlet due to a decrease in the volume capacity of the second sub-chamber, and wherein when the magnetic field is such that the diaphragm flexes into the first sub-chamber and away from the second sub-chamber, the process fluid is drawn into the second sub-chamber via the second inlet due to an increase in the volume capacity of the second sub-chamber and the process fluid is expelled from the first sub-chamber via the first outlet due to a decrease in the volume capacity of the first sub-chamber.

11. The apparatus according to claim 8, wherein the inlet accommodates pumping the process fluid into the first sub-chamber, and wherein the outlet accommodates pumping the process fluid out of the second sub-chamber.

12. The apparatus according to claim 11, wherein when the process fluid is pumped, the process fluid passes from the first sub-chamber into the second sub-chamber via the permeable section of the diaphragm.

13. An apparatus, comprising:

a chamber including a plurality of sub-chambers;

at least one inlet via which process fluid enters one or more of the plurality of the sub-chambers;

at least one outlet via which the process fluid exits one or more of the plurality of the sub-chambers; and a flexible diaphragm secured to interior walls of the chamber at a perimeter of the diaphragm between adjacent sub-chambers, the diaphragm including one or more internal closed pockets, each pocket containing a magnetic fluid therein, and the diaphragm includes a permeable section that is permeable to the process fluid in only a single direction.

14. The apparatus according to claim 13, wherein the diaphragm flexes in response to a magnetic field thereby pumping the process fluid through the plurality of sub-chambers.

15. The apparatus according to claim 13, further comprising a magnetic field source that creates a magnetic field, in response to which the diaphragm flexes to pump the process fluid through the chamber.

16. The apparatus according to claim 13, wherein when the process fluid is pumped, the process fluid passes from a first sub-chamber of the plurality of sub-chambers into a second sub-chamber of the plurality of sub-chambers via the permeable section of the diaphragm.

17. The apparatus according to claim 14, wherein the plurality of sub-chambers includes a first sub-chamber and a second sub-chamber, and wherein the diaphragm flexes according to a magnetic field created near the diaphragm thereby affecting a volume capacity of the first and second sub-chambers simultaneously.

18. The apparatus according to claim 17, wherein the first sub-chamber includes the at least one inlet having a valve disposed at a wall portion of the first sub-chamber, and wherein the second sub-chamber includes the at least one outlet having a valve disposed at a wall portion of the second sub-chamber.

19. The apparatus according to claim 17, further comprising a magnetic field source that creates the magnetic field, so as to pump the process fluid into the first sub-chamber via the at least one inlet and out of the second sub-chamber via the at least one outlet.

* * * * *